United States Patent [19]

White

[11] 4,348,921

[45] Sep. 14, 1982

[54] OPEN END WRENCH

[76] Inventor: Anthony D. White, Apartment GLH, 254 Park Ave. South, New York, N.Y. 10010

[21] Appl. No.: 186,488

[22] Filed: Sep. 12, 1980

[51] Int. Cl.[3] ..... B25B 13/28

[52] U.S. Cl. ..... 81/91 C

[58] Field of Search ..... 81/91 R, 91 A, 91 C, 81/126

[56] References Cited

U.S. PATENT DOCUMENTS

| | | | |
|---|---|---|---|
| 923,942 | 7/1908 | Brockway . | |
| 2,353,901 | 7/1944 | Jires . | |
| 2,508,604 | 5/1950 | Greer et al. . | |
| 2,594,154 | 4/1952 | Greer et al. | 81/91 C |
| 2,719,447 | 10/1955 | Ford . | |
| 2,787,180 | 4/1957 | Fish . | |
| 3,535,960 | 10/1970 | Borries . | |
| 3,620,105 | 11/1971 | Batton . | |
| 3,979,977 | 9/1976 | Dorma . | |

FOREIGN PATENT DOCUMENTS

| | | | |
|---|---|---|---|
| 10549 | of 1905 | United Kingdom | 81/91 C |

OTHER PUBLICATIONS

Wrench described as self-adjuster Popular Science Sep. 19, 1980 offered by Lynwood Distributing, Drawer T, Midland Park, NJ 07432.

*Primary Examiner*—James G. Smith

*Attorney, Agent, or Firm*—Karl F. Milde, Jr.

[57] ABSTRACT

An open ended wrench is disclosed for engaging a nut or other object when moved in one direction and disengaging from the nut or object when moved in an opposite direction. The wrench consists of a first and a second jaw mounted on a handle and an adjusting member within the wrench for moving each of the jaws towards one another when the handle is moved in one direction and for moving each of the jaws away from one another when the handle is moved in another direction. The handle is operatively associated with each of the jaws through the adjusting member.

51 Claims, 17 Drawing Figures

OPEN END WRENCH

BACKGROUND OF THE INVENTION

Open ended ratchet wrenches are disclosed in the United States Patents to Brockway, Nos. 923,942; Ford, 2,719,447; Jires, 2,353,901; Greer et al., 2,508,604; Fish, 2,787,180; Borries, 3,535,960; Borries, 3,604,106; Batton, 3,620,105; Dorma, 3,979,977.

All of the aforementioned references with the exception of the Ford patent, describe open ended ratchet wrenches in which the jaws of the wrench rotate in a frame having an opening corresponding to the width of the jaws and in which the wrench can only be removed from the nut when the jaws are aligned with the opening after a tightening or untightening operation. The Ford wrench describes a device in which the jaws are always returned to a position in which they are aligned with the opening in the frame after being rotated a fraction of a turn to apply a tightening or untightening force to a nut or other object in the jaws. The difficulty with the device of the Ford reference is that the frame is excessively large and the jaws are arranged to grip a nut or other workpiece at a corner thereof such as the intersection of two faces of a hexagonal nut. The jaws in this respect do not grip the nut along the entire flat surface of opposite hexagonal faces or opposite faces of other similar type nuts. As a result, with the rather small area of engagement between the jaws and the corner of the nut, the tightening force or moment of force that can be applied to the nut by this device is minimal, lest the jaws damage the nut and/or slip off of the nut.

Accordingly, it is an object of the present invention to overcome these and other difficulties encountered in the prior art.

It is also an object of the present invention to provide an open ended wrench for applying a moment of force to a nut or other work piece through a pair of jaws when a moment of force is applied to said wrench in one direction and whereby each of the jaws are opened when the wrench is moved in another direction without removing the wrench from the workpiece or the nut.

It is a further object of the present invention to provide a wrench of the foregoing description which may be used on nuts or work pieces of varying sizes, the jaws of such wrench being adjustable to accommodate such nuts or workpieces.

These and other objects have been achieved according to the present invention which will be understood more completely by reference to the appended claims, and drawings as well as the following disclosure.

SUMMARY OF THE INVENTION

The present invention relates to a a wrench comprising a handle, a first and a second jaw, each of these jaws having an axis along which a moment of force is transmitted from the handle. The handle has an axis along which a moment of force is applied to each of the jaws. An adjusting member is provided in the wrench for moving each of the jaws towards one another when the handle is moved in one direction and for moving each of the jaws away from one another when the handle is moved in another direction, the handle being operatively associated with each of the jaws through the adjusting member.

The axes of the jaws are in substantially parallel alignment when the jaws are moved toward one another and away from one another in one embodiment of the invention.

The adjusting member is secured to the handle by a plate pivot and comprises a member in the wrench for moving each of the jaws towards one another when the handle is moved in one direction to transmit a moment of force to each of the jaws, and for moving each of the jaws away from one another when the handle is moved in the opposite direction. When the jaws are moved toward and away from one another by moving the handle the plate pivot is at a fixed point and the jaws move toward and away from one another relative to this point.

In another embodiment, the adjusting member may comprise a plate member for holding the jaws, the first jaw being pivotally secured to the plate member by means of a first pivot operatively associated with the first jaw the longitudinal axis of the first pivot being transverse to the direction in which the handle is moved. A second jaw similarly is pivotally secured to the plate member opposite the first jaw by means of a second pivot operatively associated with the second jaw intermediate the ends thereof, the longitudinal axis of the second pivot being transverse to the direction in which the handle is moved. The handle is pivotally secured to the plate member by the plate pivot, the longitudinal axis thereof being transverse to the direction in which the handle is moved. The second pivot is positioned between the first pivot and the plate pivot. One end of the handle extends into jaw engaging members for engaging and pivotally moving each of the jaws when a moment of force is applied to the handle.

In a further embodiment the adjusting member comprises gear teeth on the handle, and a first pinion member on the first jaw between the handle and the first pivot for operatively engaging the gear teeth. A second pinion member is provided on the second jaw between the handle and the second pivot for operatively engaging the gear teeth as well.

The adjusting member may also comprise a first slot and a first pin operatively associated with the first jaw and the handle and positioned between the first pivot and the handle. The first slot is arranged to slidably receive the first pin. A second slot and a second pin is provided which is operatively associated with the second jaw and the handle and positioned between the second pivot and the handle. The second slot slidably receives the second pin. In this respect, the pin may be on the jaw and the slot in the handle or vice versa as long as the pin and slot configuration is maintained. When the pin and slot arrangement is used as the adjusting member, the first slot may extend along a first slot longitudinal axis at an angle to the first jaw axis and the second slot may extend along a longitudinal axis at an angle to the second jaw axis. The first slot longitudinal axis and the second slot longitudinal axis are arranged in this respect to point toward the handle or intersect the handle axis.

In a further embodiment the adjusting member may comprise a first cam and a second cam on the handle, in combination with a first cam receiving or cam follower surface on the first jaw between the handle and the first pivot and operatively engaged by the first cam for pivoting the first jaw toward the second jaw. A second cam receiving or cam follower surface is also provided on the second jaw between the second pivot and the handle and is operatively engaged by the second cam for pivoting the second jaw toward the first jaw.

The first cam receiving surface is on a surface of the first jaw facing away from the second jaw and the second cam receiving surface is on a surface of the second jaw facing the first jaw. Where the adjusting member comprises the gear and cam arrangements, a portion of the length of each of the jaws nearest the handle may be angled inwardly towards the handle. In the case of the gear and pinion arrangement, the pinion member is positioned along the length nearest the handle. In the case of the cam embodiment, the cam receiving surfaces are along the length of the jaws nearest the handle.

In order to provide jaws that are adjustable to fit a variety of sizes of nut or other workpieces, the plate member may comprise a first plate pivotally secured to the first jaw through the first pivot and a second plate pivotally secured to the second jaw through the second pivot, the second plate also being pivotally secured to the handle through the plate pivot. The first plate and the second plate are arranged to slide over one another at an angle to the axes of the jaws. Guide members are also provided for guiding the plates when sliding over one another at the aforesaid angle.

The guide member may comprise a tongue and groove member in the first and second plates for guiding the plates at the aforementioned angle. In this respect the tongue may be positioned on the first plate and the groove on the second plate or vice versa and a plurality of tongue and groove arrangements may be used.

In a further embodiment of the sliding plate arrangement, the first plate may extend around the first jaw and the second plate may extend around the second jaw so that the first and second plates envelop the jaws and thereby provide greater structural rigidity and dimensional stability to the wrench.

A resilient member may be affixed to the wrench for returning the jaws to a set position after the jaws are opened.

The first pivot and the second pivot may be positioned to lie along an axis that intersects the longitudinal jaw axes at an angle from about 45° to about 80°. The jaw axes may be at a 45° angle in a particular embodiment of the invention. This arrangement is especially useful where the slot and pin arrangement is employed as the adjustment member and where the nut on which the wrench is used has a square head. Generally, this angle is one-half of the angle of the intersecting sides of the nut or work piece, where the nut or work piece is a polygon. Similarly, the first pivot and second pivot may lie along an axis that intersects the longitudinal jaw axes at a 60° angle, this wrench being especially useful on equilateral hexagonal nuts or workpieces. An 80° angle may be used in this respect and is especially useful where the wrench is employed on round nuts or round workpieces.

In yet another embodiment, the ratio of the distance from the first pivot to the jaw engaging member next adjacent the first pivot and the distance from the jaw engaging member next adjacent the first pivot to the plate pivot comprises a first ratio which is substantially fixed and similarly the ratio of the distance from the second pivot to the jaw engaging member next adjacent to the second pivot and the distance from said jaw engaging member next adjacent the second pivot to the plate pivot is substantially the same as the first ratio. The ratios in one embodiment are greater than one and may be at a fixed value in the range from about 1:5 to 1 to about 5:1. When the jaws are used to engage a round work piece the ratios are sufficiently high to enable them to grip the round surface as in the case where the jaws are flat and used on such a surface.

The invention also relates to a wrench comprising a handle, a first jaw and a second jaw, each of said jaws having a longitudinal axis along which a moment of force is transmitted from said handle, said handle having an axis along which a moment of force is applied to each of said jaws. Each of said jaws' longitudinal axes turns on a pivot, each said pivot being diagonally opposed to one another on a diagonal axis of a constant length. A transverse axis extends from each of said pivots to said longitudinal axis opposite each of said pivot, both said transverse axes being parallel, and said longitudinal axes being parallel. The longitudinal and transverse axes of said first jaw and pivot and said longitudinal and transverse axes of said second jaw and pivot lie in a plane and define a parallelogram having a center point at which the transverse mean axis and the longitudinal mean axis intersect, said diagonal axis also intersecting said center. An adjusting member is provided in the wrench for pivoting each of said jaws at said pivots and for moving each of said jaws towards one another thereby decreasing the distance between the said longitudinal axes and increasing the distance between the transverse axes when the adjusting member is moved in one direction and for moving each of the jaws away from one another thereby increasing the distance between said longitudinal axes and decreasing the distance between said transverse axes when the adjusting member is moved in another direction.

DESCRIPTION OF THE SEVERAL EMBODIMENTS

Figure 1:
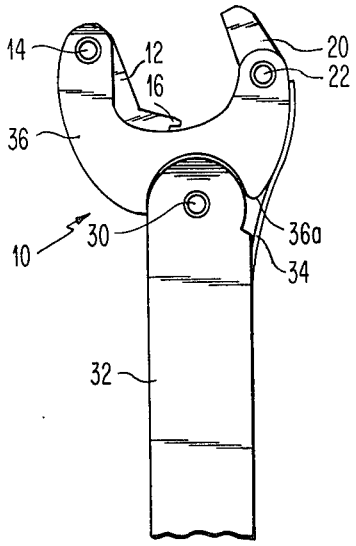
FIG. 1 comprises a side elevation of an open end wrench having gear adjusting members for moving the jaws thereof towards one another and away from one another.
Figure 2:
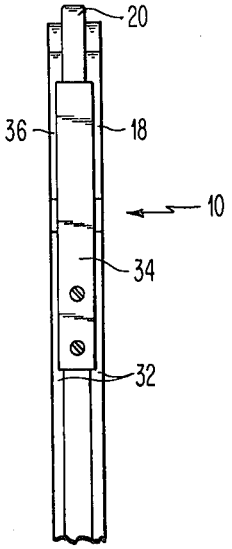
FIG. 2 comprises a front elevation of the wrench illustrated in FIG. 1.

Referring to FIGS. 1 through 15 a wrench 10 is shown in FIGS. 1 through 4 having a first jaw 12 pivotally mounted on a pivot 14 secured to a plate 18. The jaw 12 terminates in pinion teeth 16 jaw 12 has a longitudinal axis, which in the illustration of FIGS. 1 through 4 runs parallel to the face of the jaw 12 and similarly, jaw 20 has a longitudinal axis which in the illustrations runs parallel to the face of the jaw 20. The pivot 14 is mounted at the end of the jaw farthest from the handle 32. Jaw 20 is pivotally mounted by means of pivot 22 on plate 18, pivot 22 being mounted intermediate the ends of jaw 20. Jaw 20 terminates in a pinion gear 24 which is arranged to be operatively engaged by gear teeth 28 on handle 32 and similarly, the pinion gear 16 on jaw 12 is arranged to be operatively engaged by the gear teeth 26 on handle 32. Handle 32 is also pivotally mounted on plate 18 by means of a pivot 30. The longitudinal axes of pivots 14, 20 and 30 are transverse to the plane of the plate 18 and the pivot 22 is mounted in between the pivots 14 and 30. A resilient member such as a spring 34 is secured to the handle 32 and slidingly and resiliently engages jaw 20 to move jaw 20 towards jaw 12. A plate 36 is positioned opposite plate 18 and also receives the pivots 14 and 22.

Plate 36 has a stop **36*a* which allows the jaws mounted in plates 18 and 36 to rotate about pin 30 to a point where stop 36*a* will engage the handle 32 and prevent further rotation about pin 30. A similar stop (not illustrated) is also provided on plate 18 opposite stop 36*a* for controlling the degree of rotation of plates 18 and 36**.

Figure 3:
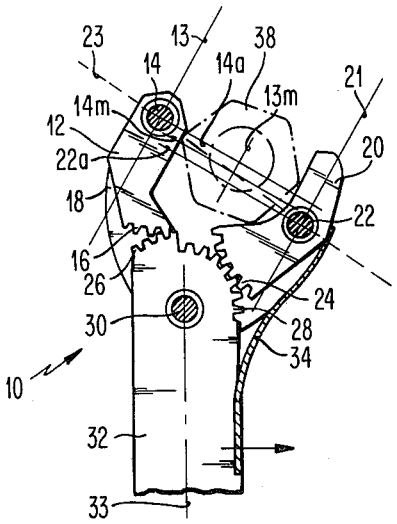
FIGS. 3 and 4 comprise side elevations in section of the wrench illustrated in FIG. 1.
Figure 4:
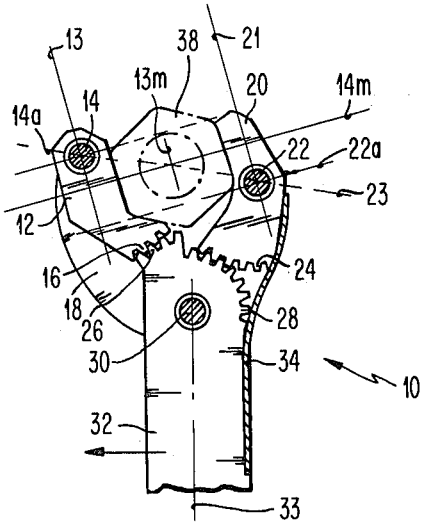

In use, and referring to FIGS. 3 and 4, when the handle as illustrated in FIG. 3 is moved in the direction towards FIG. 4, handle 32 pivots about the pivot 30 and gear 26 rotates to open jaw 12 and jaw 20 by respectively engaging pinion gears 16 and 24. Nut 38 positioned between jaws 12 and 20 is not engaged during this rotation and the wrench may be moved to position the jaws against a flat surface of the nut. When this positioning is realized, the resilient member 34 moves the jaws 12 and 20 into engagement with the flat surfaces of the nut 38 as illustrated in FIG. 4 and when the handle 32 of FIG. 4 is moved towards FIG. 3 the jaws 12 and 20 close with force so they may grip the nut 38 along its flat surfaces and a moment of force applied to the longitudinal axis of the handle 32 as illustrated in FIG. 4 will be transmitted to the longitudinal axes of the jaws 12 and 20 and in turn this moment of force will be transmitted to the nut 38. The operation is repeated several times so that the nut is rotated in a clockwise direction. In order to turn the nut in the opposite direction the wrench is reversed so that plate 18 faces upwardly and plate 36 faces downwardly and the process repeated. By employing the wrench of the invention as described above, the wrench is moved in an oscillating direction on the nut 38 to rotate it in a clockwise or counterclockwise direction without removing the wrench from the nut.

Each of the jaws 12 and 20 has a longitudinal axis 13 and 21, respectively along which a moment of force is transmitted from said handle, said handle having an axis 33 along which a moment of force is applied to each of said jaws, each of said jaws' longitudinal axes turns on a pivot. Each said pivot 14 and 22 is diagonally opposed to one another on a diagonal axis 23 of a constant length, a transverse axis **14*a* and 22*a* extending from each of said pivots to said longitudinal axis opposite each of said pivot, both said transverse axes being parallel, and said longitudinal axes being parallel. The longitudinal and transverse axes of the first jaw and pivot and said longitudinal and transverse axes of said second jaw and pivot lie in a plane and define a parallelogram having a center point at which the transverse mean axis 14*m* and the longitudinal mean axis 13*m* intersect, said diagonal axis 23** also intersecting said center.

Figure 5:
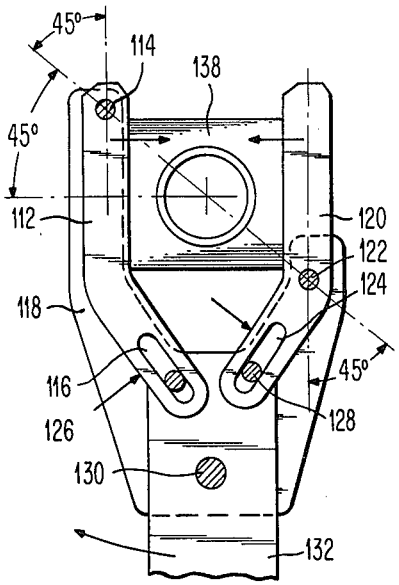
FIGS. 5, 6 and 7 are side elevations in section and show slot and pin adjusting members of a wrench of the present invention for moving the jaws thereof towards and away from one another, FIG. 5 having the jaw pivot members at a 45° angle for engaging a square nut or workpiece, FIG. 6 having the jaw pivot members at a 30° angle for engaging an equilateral hexagonal nut or a workpiece, and FIG. 7 showing the jaw pivots at a 10° angle for engaging a round nut or workpiece.
Figure 6:
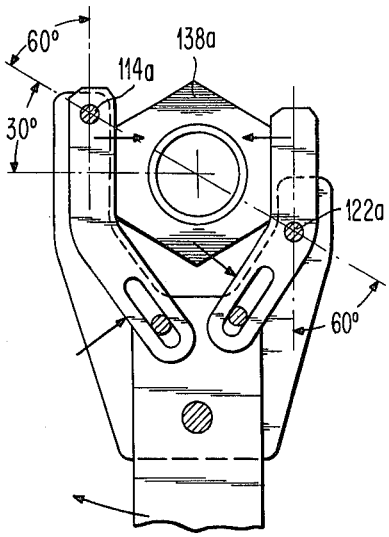
Figure 7:
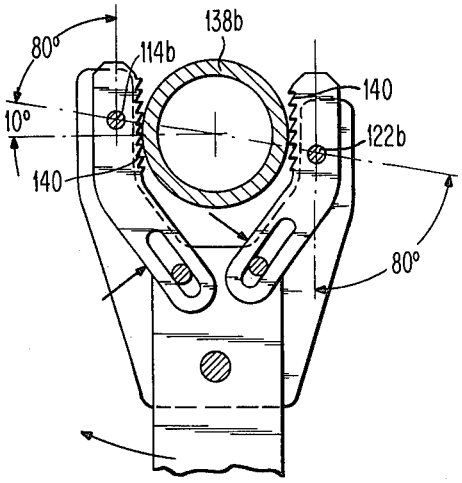

Referring to FIGS. 5 through 7, a wrench 100 is illustrated having a jaw 112 pivotally mounted by means of pivot 114 on plate 118. The pivot 114 is mounted at the end of jaw 112. Jaw 120 is also provided which is pivotally mounted on plate 118 by means of pin 122 positioned intermediate the ends of jaw 120. Jaw 112 is provided with a longitudinal slot 116 for slidably receiving a pin 126. Jaw 120 is also provided with a longitudinal slot 124 for slidably receiving pin 128. The handle 132 is pivotally mounted on plate 118 by means of pivot 130. A square nut 138 is positioned in between the jaws 112 and 120 and the wrench is operated in the same manner as the wrench illustrated in FIGS. 1–4 by moving the handle 132 back and forth. In use, movement of the handle 132 of the wrench in FIG. 5 in a direction away from the wrench illustrated in FIG. 6 will cause the jaws 112 and 120 to open and movement in the opposite direction will cause the jaws to close. The longitudinal axes of the jaws 112 and 120 are parallel to one another and the faces of these jaws are also parallel to their longitudinal axes. Pivots 114 and 122 are intersected by an axis that is at a 45° angle to the longitudinal axes of both of these jaws, it having been found that this arrangement is better suited for gripping a square nut 138 within the jaws 112 and 120. The longitudinal axes of the slots 116 and 124 are angled so as to intersect the longitudinal axis of the handle 132.

The wrenches of FIGS. 6 and 7 are substantially similar in construction and operation to the wrench illustrated in FIG. 5 with the difference that the pivots **114*a* and 122*a* are intersected by an axis that is at an angle of 60° to the longitudinal axes of the jaws of the wrench to better engage the equilateral hexagonal nut 138*a*. The pivots 114*b* and 122*b* are intersected by an axis that is at an 80° angle to the longitudinal axis of the jaws of the wrench illustrated in FIG. 7 to better engage the round nut 138*b***.

In one embodiment of the invention as illustrated only by way of example in FIG. 7 it has also been found that when using a wrench having flat jaws for gripping a round surface that the ratio of the distance from the first pivot to the jaw engaging member next adjacent the fiber pivot and the jaw engaging member to the plate pivot should be greater than one and similarly for the second pivot where the ratios for the first and second pivot are substantially the same. It has been determined that these ratios provide maximum gripping force and minimum slippage.

Figure 8:
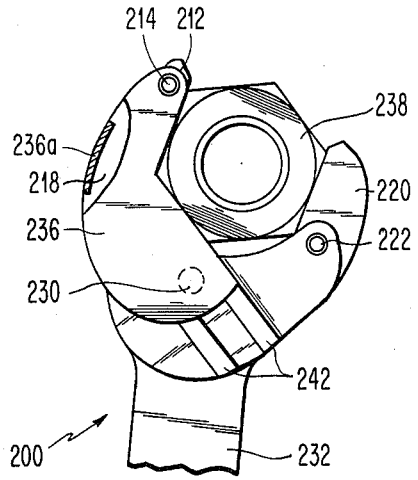
FIG. 8 comprises a side elevation partially in section illustrating a wrench having pin and slot adjusting members for moving each of the jaws towards one another and away from one another and in which the plate member on which the jaws are mounted comprises a first and second plate slidably engaging one another so that the wrench may be used on nuts or workpieces of various sizes.
Figure 9:
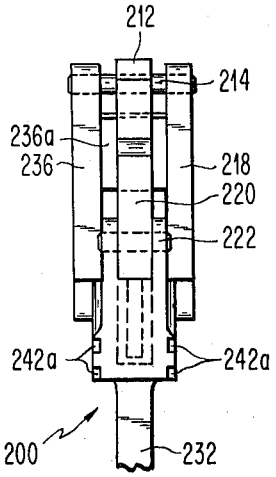
FIG. 9 is a front elevation in section of the wrench of FIG. 8, whereas FIG. 10 comprises a three-dimensional exploded view of the wrench of FIG. 8.
Figure 10:
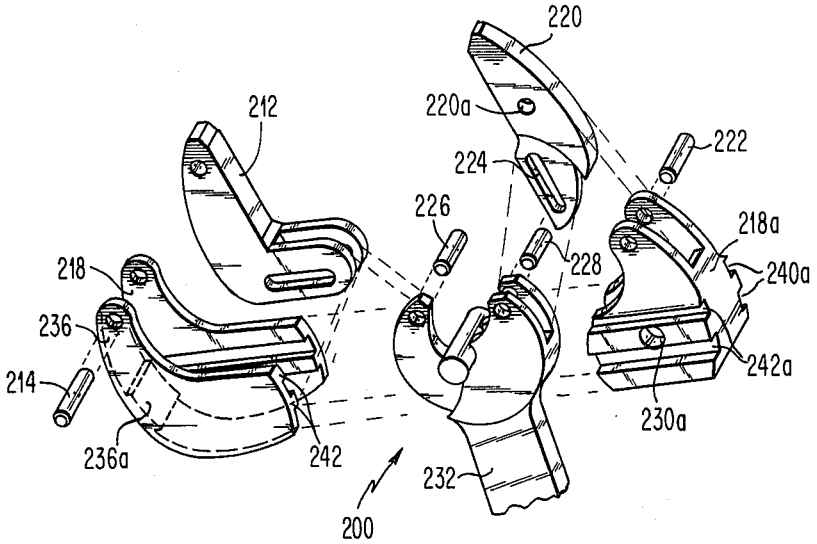

FIGS. 8, 9 and 10 illustrate a wrench 200 comprising jaws 212 and 220. Jaw 212 is pivotally secured to plates 218 and 236 by means of a pivot 214 mounted at the end of the jaw. The other end of jaw 212 has a slot 216 therein for slidably receiving a pin 226 secured in handle 232. Jaw 220 is pivotally mounted on a plate 218*a* by means of a pin 222 passing through opening 222*a* in the jaw said pin being secured in plate 218*a*. The pin 222 is arranged to pivotally engage jaw 220 at a point intermediate the ends of the jaw. A longitudinal slot 224 is provided in the jaw 220 for slidably receiving a pin 228 secured in handle 232. Plate 218*a* is pivotally mounted on the handle 232 by means of pin 230 which passes through the opening 230*a* in plate 218*a*. The plates 218 and 236 which are joined together by a member 236*a* are arranged to slidably engage plate 218*a* by means of tongues 240 on plate 218 which engage grooves 240*a* on plate 218*a* and tongues 242 which slidably engage grooves 242*a* on plate 218*a*. The wrench of FIGS. 8, 9 and 10 operates in a manner similar to that of the wrench illustrated in FIGS. 1 through 4 with the exception of plates 218 and 236 which slidably engage plate 218*a* at a fixed angle, to allow the jaws 212 and 220 to be adjusted to accommodate nuts of different sizes such as the nut 238 illustrated in FIG. 11 or the nut 238*a* illustrated in FIG. 12.

The adjustment of the jaws is effective on a continuous basis, rather than in increments, within the range of nut sizes accommodated by the wrench. For this reason the wrench can be utilized with nuts, pipes or even irregular shaped workpieces in both inch and metric sizes.

Figure 13:
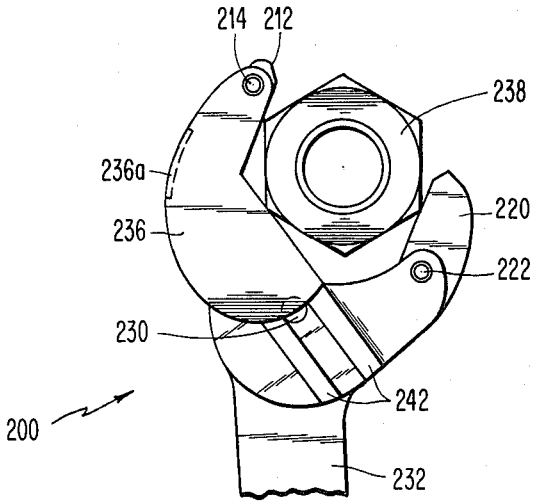
FIG. 13 comprises a side elevation partially in section illustrating how the wrench of FIG. 8 turns around a nut when moving on the nut in a non-engaging direction prior to the application of a moment of force to the wrench to cause the jaws to engage the nut.
Figure 11:
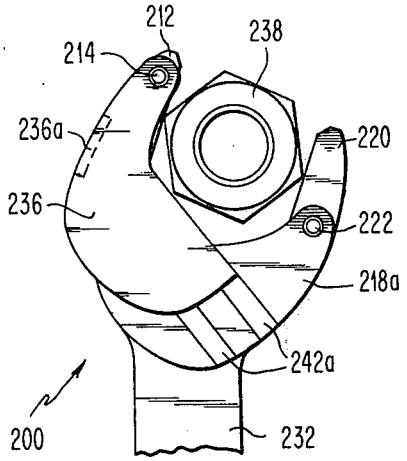
FIGS. 11 and 12 illustrate the use of the wrench of FIG. 8 on nuts of varying sizes and show how the sliding plate functions to allow the jaws of the wrench to accommodate relatively large (FIG. 11) and small (FIG. 12) nuts.
Figure 12:
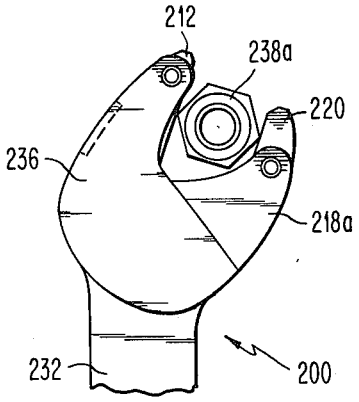

Referring to FIGS. 11 and 13, it can be seen that when in use, the handle of the wrench when moved to the left will grip the nut 238 as illustrated in FIG. 11 and when moved to the right will allow the jaws 212 and 220 to separate sufficiently to allow the wrench to move over the nut 238 without gripping it.

Figure 14:
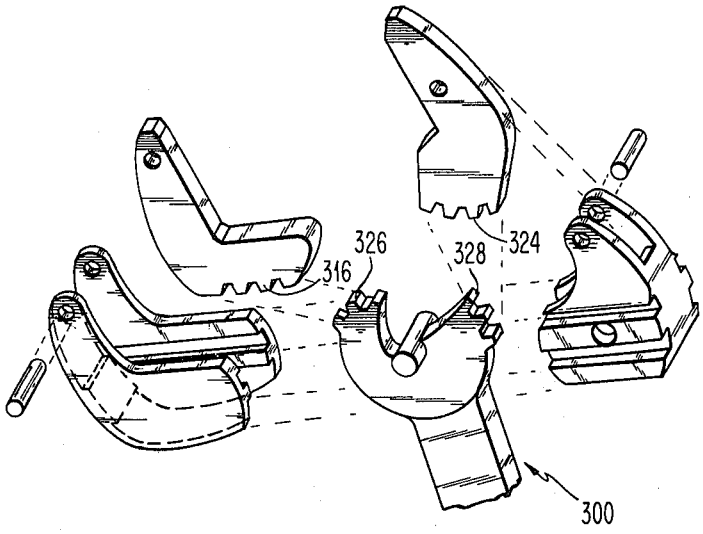
FIG. 14 comprises an exploded three-dimensional view of a wrench according to the present invention similar to the wrench of FIG. 10, however wherein gear and pinion members are employed on the handle and jaws respectively as the adjusting members in lieu of the slots and pins arrangement of the wrench of FIG. 10.

The wrench 300 illustrated in FIG. 14 is substantially similar to the wrench illustrated in FIGS. 8–10 with the exception that a gear 316 is provided in lieu of the slot 216 and a gear 326 is provided to operatively engage gear 316 in lieu of the pin 326. Similarly, a gear 324 is used in lieu of the gear 224 and gear 328 is used in lieu of pin 228. The advantage of the wrench 300 is that more positive engagement by the handle with the jaws is possible by using the gear arrangement in lieu of the pin and slot arrangement. The wrench 300 functions in the same manner as the wrench 200 the only difference between the two being the gear members employed for moving the jaws toward and away from one another.

Figure 15:
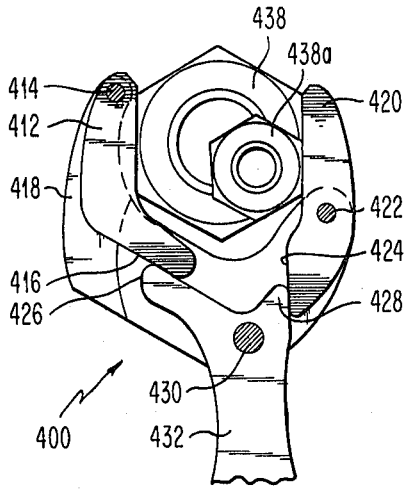
FIG. 15 comprises a side elevation in section of a wrench according to the present invention in which the adjusting members for moving the jaws of the wrench toward and away from one another comprise two cams on the handle and cam receiving or cam follower surfaces on the jaws.

The embodiment illustrated in FIG. 15 comprises a wrench 400 having a jaw 412 with a pivot 414 at the end thereof pivotally mounting the jaw to a plate 418. A jaw 420 is also provided which is pivotally mounted to a plate for slidably engaging plate 418 similar to the plate arrangement 218 and 218*a* illustrated in FIG. 10. The pivot 422 is mounted intermediate the ends of the jaw 420. A handle 432 is provided which is pivotally secured by means of pivot 430 to the plate on which pivot 422 is secured. Jaw 412 has a cam follower or cam receiving surface 416 which is operatively engaged by a cam 426 extending from the handle 432. The cam receiving surface 416 faces away from the direction of the face of the jaw 412. A cam follower or cam receiving surface 424 is provided on jaw 420 and is operatively engaged by a cam 428 extending from handle 432. The cam receiving surface 424 faces in the same direction as the inward face of the jaw 420. In use, the wrench 400 functions in substantially the same manner as the wrench 200.

Figure 16:
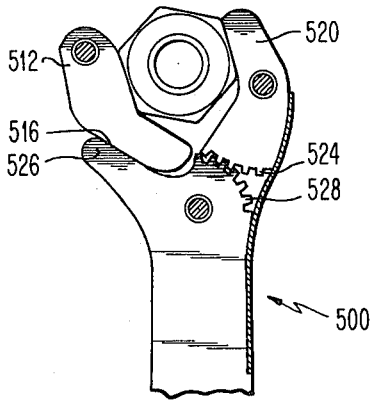
FIG. 16 comprises a side elevation of a wrench in which the adjusting members are a set of gears and a cam and cam follower.
Figure 17:
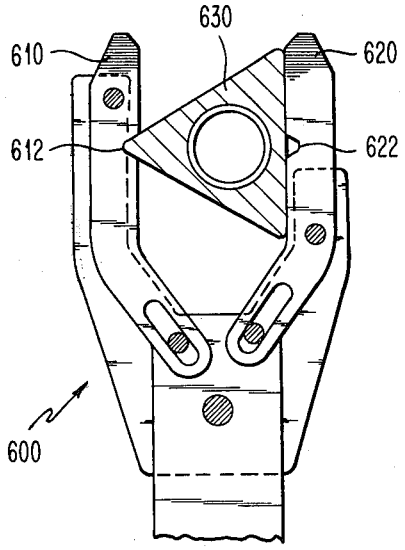
FIG. 17 comprises a side elevation of a wrench suitable for turning a three-sided nut.

Referring to FIG. 16 the wrench 500 comprises a combination of the adjusting members of the wrenches of FIGS. 1–4 and FIG. 15 in that the jaw 512 has a cam receiving surface 516 engaged by cam 526 and jaw 520 terminates in pinion 524 which is operatively engaged by gear 528. The device of FIG. 16 operates in the same manner as that of FIG. 15 and FIGS. 1–4 where the jaws 512 and 520 respectively are concerned. Referring to FIG. 17, the wrench 600 comprises two jaws 610 and 620 having notches 612 and 627, approximately midway along their flat gripping surfaces. These notches make it possible to grip and rotate a three-sided nut 630.

It should be noted that in all of the embodiments shown, that when the jaws of wrench 10, 100, 200, 300, 400 and 500 are moved towards and away from one another by the jaw adjusting members the longitudinal axes of the jaws are substantially parallel to one another. This is achieved by maintaining the ratios of the distances from the first pivot to the jaw engaging means next adjacent said first pivot and the plate pivot at a substantially fixed value and maintaining substantially the same raio for the similar dimensions for the second pivot and plate pivot. The wrench handle can be moved in one direction when a workpiece such as a nut is positioned within the jaws so as to cause the jaws to move away from one another and allow the workpiece to remain within the jaws during this movement. Moving the handle in the opposite direction, causes the jaws to move towards one another and engage the workpiece thereby allowing the open ended wrench to be moved back and forth on a workpiece without having to remove it. This is especially advantageous in loosening or tightening a nut in that the wrench does not have to be removed from the nut each time it is turned in one direction. With an open ended wrench having fixed jaws, the wrench has to be removed from the nut each time it is to be turned in one direction. This problem is avoided by the use of the wrench of the present invention. The problem of the prior art open ended ratchet wrenches is also avoided in that the jaws do not have to be aligned with an opening in the frame in which the jaws are mounted in order to remove the wrench from the nut or workpiece that it is engaging. The wrench of the present invention functions in the same manner as conventional ratchet type socket wrenches with the advantage that it does not have the bulk of a ratchet wrench and allows the wrench to be used on nuts or work pieces that are otherwise inaccessible to a socket type ratchet wrench.

Finally, a still further, significant advantage of the wrench of the present invention, as opposed to open end wrenches, box wrenches, and socket wrenches, is its ability to clamp the jaws firmly against the sides of a nut, thereby distributing the applied force equally against the flat surfaces of the nut. In fact, the greater the resistance exhibited by a nut to turning, the greater will be the clamping force hoding the jaws of the wrench in contact with the sides of the nut. In short, the wrench of the present invention exhibits a binding action when utilized to turn a nut thereby preserving the integrity of the surfaces of the nut and applying a greater torque.

Although the invention has been described by reference to some embodiments, it is not intended that the novel wrench be limited thereby but that modifications thereof are intended to be included as falling within the broad spirit and scope of the foregoing disclosure and the following claims and the appended drawings.

What is claimed is:

1. A wrench comprising a handle, a first jaw and a second jaw, each said jaw having an axis along which a moment of force is transmitted from said handle, said handle having an axis along which a moment of force is applied to each of said jaws, adjusting means in said wrench for moving each of said jaws towards one another when said handle is moved in one direction and for moving each of said jaws away from one another when said handle is moved in another direction, said handle being operatively associated with each of said jaws through said adjusting means, said adjusting means comprising (1) a pivot; (2) means in said wrench for moving each of said jaws towards one another when said handle is moved in one direction to transmit a moment of force to each of said jaws, and for moving each of said jaws away from one another when said handle is moved in the opposite direction, said pivot being at a fixed point when said jaws are moved toward and away from one another by moving said handle; and (3) plate means for holding said jaws, said first jaw being pivotally secured to said plate means by means of a first pivot operatively associated with said first jaw, the longitudinal axis of said first pivot being transverse to the direction in which said handle is moved, said second jaw being pivotally secured to said plate means opposite said first jaw by means of a second pivot operatively associated with said second jaw and intermediate the ends thereof, the longitudinal axis of said second pivot being transverse to the direction in which said handle is moved, said handle being pivotally secured to said plate means by a plate pivot, the longitudinal axis thereof being transverse to the direction in which said handle is moved, said handle extending to jaw engaging means for engaging and pivotally moving each of said jaws when a moment of force is applied to said handle.

2. The wrench of claim 1, where said adjusting means further comprises gear teeth on said handle, first pinion means on said first jaw between said handle and said first pivot for operatively engaging said gear teeth, second pinion means on said second jaw between said handle and said second pivot for operatively engaging said gear teeth.

3. The wrench of claim 2, where the length of each of said jaws nearest said handle angle inwardly toward said handle, said pinion means being positioned along said length nearest said handle.

4. The wrench of claim 1 where said adjusting means further comprise a first slot and first pin operatively associated with said first jaw and said handle, and positioned between said first pivot and said handle, said first slot slidably receiving said first pin, a second slot and second pin operatively associated with said second jaw and said handle and positioned between said second pivot and said handle, said second slot slidably receiving said second pin.

5. The wrench of claim 4 where said first slot extends along a first slot longitudinal axis at an angle to said first jaw axis, said second slot extends along a longitudinal axis at an angle to said second jaw axis, said first slot longitudinal axis and said second slot longitudinal axis pointing toward said handle.

6. The wrench of claim 1 where said adjusting means further comprises a first cam and a second cam, on said handle, a first cam receiving surface on said first jaw between said handle and said first pivot operatively engaged by said first cam for pivoting said first jaw toward said second jaw, a second cam receiving surface on said second jaw between said second pivot and said handle operatively engaged by said second cam for pivoting said second jaw toward said first jaw.

7. The wrench of claim 6 where said first cam surface is on a surface of said first jaw facing away from said second jaw and said second cam surface is on a surface of said second jaw facing toward said first jaw.

8. The wrench of claim 7 where the length of each of said jaws nearest said handle angles inwardly towards said handle, said cam receiving surfaces being along said length nearest said handle.

9. The wrench of claim 1 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

10. The wrench of claim 2 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

11. The wrench of claim 4 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

12. The wrench of claim 6 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

13. The wrench of claim 9 where said guide means comprise tongue and groove means in said first and second plate for guiding said plates at said angle.

14. The wrench of claim 9 where said first plate extends around said first jaw and said second plate extends around said second jaw.

15. The wrench of claim 1 further comprising resilient means affixed to said wrench for returning said jaws to a set position after said jaws are opened.

16. The wrench of claim 1 where said first pivot and said second pivot lie along an axis that intersects said longitudinal jaw axes at a 45° angle.

17. The wrench of claim 1 where said first pivot and said second pivot lie along an axis that intersects said longitudinal jaw axes at a 60° angle.

18. The wrench of claim 1 where said first pivot and said second pivot lie along an axis that intersects said longitudinal jaw axes at an 80° angle.

19. The wrench of claim 1 where the ratio of the distance from:

(1) said first pivot to said jaw engaging means next adjacent first pivot and (2) said jaw engaging means to said plate pivot comprises a first ratio which is at substantially fixed value and the ratio of the distance from:

(1) said second pivot to said jaw engaging means next adjacent said second pivot and (2) said jaw engaging means to said plate pivot comprising a second ratio substantially the same as said first ratio.

20. The wrench of claim 19 where said first and second ratios are greater than one.

21. The wrench of claim 20 where said first and second ratios are sufficiently high to enable said jaws to firmly grip a rounded work piece.

22. The wrench of claim 19 where said ratios are at a fixed value in the range from about 1.5:1 to about 5:1.

23. The wrench of claim 1 where the axes of said jaws are in substantially parallel alignment when said jaws are moved toward one another and away from one another.

24. The wrench of claim 1 wherein at least one of said first jaw and said second jaw have a recess therein in the gripping surface thereof for gripping the edge of a nut.

25. The wrench of claim 1 wherein at least one of said first jaw and second jaw have teeth therein in the gripping surface thereof for gripping a round workpiece.

26. A wrench comprising a handle, a first jaw and a second jaw, each of said jaws having a longitudinal axis along which a moment of force is transmitted from said handle, said handle having an axis along which a moment of force is applied to each of said jaws, each of said jaws' longitudinal axes turns on a pivot, each said pivot being diagonally opposed to one another on a diagonal axis of a constant length, a transverse axis extending from each of said pivots to said longitudinal axis opposite each of said pivots, said transverse axes being parallel, said longitudinal axes being parallel, said longitudinal and transverse axes of said first jaw and pivot and said longitudinal and transverse axes of said second jaw and pivot lie in a plane and defining a parallelogram having a center point at which the transverse mean axis and the longitudinal mean axis intersect, said diagonal axis also intersecting said center, and adjusting means in said wrench for pivoting each of said jaws at said pivots and for moving each of said jaws towards one another thereby decreasing the distance between the said longitudinal axes and increasing the distance between the transverse axes when said adjusting means is moved in one direction and for moving each of said jaws away from one another thereby increasing the distance between said longitudinal axes and decreasing the distance between said transverse axes when said adjusting means is moved in another direction.

27. The wrench of claim 26 where said adjusting means comprises plate means for holding said jaws, said first jaw pivotally secured to said plate means by means of a first pivot operatively associated with said first jaw, the longitudinal axis of said first pivot being transverse to the direction in which said handle is moved, said second jaw pivotally secured to said plate means opposite said first jaw by means of a second pivot operatively associated with said second jaw and intermediate the ends thereof, the longitudinal axis of said second pivot being transverse to the direction in which said handle is moved, said handle being pivotally secured to said plate means by a plate pivot, the longitudinal axis thereof being transverse to the direction in which said handle is moved, said second pivot being positioned between said first pivot and said plate pivot, said handle extending to jaw engaging means for engaging and pivotally moving each of said jaws when a moment of force is applied to said handle.

28. The wrench of claim 27, where said adjusting means further comprises gear teeth on said handle, first pinion means on said first jaw between said handle and said first pivot for operatively engaging said gear teeth, second pinion means on said second jaw between said handle and said second pivot for operatively engaging said gear teeth.

29. The wrench of claim 28, where the length of each of said jaws nearest said handle angle inwardly toward said handle, said pinion means being positioned along said length nearest said handle.

30. The wrench of claim 27 where said adjusting means further comprise a first slot and first pin operatively associated with said first jaw and said handle, and positioned between said first pivot and said handle, said first slot slidably receiving said first pin, a second slot and second pin operatively associated with said second jaw and said handle and positioned between said second pivot and said handle, said second slot slidably receiving said second pin.

31. The wrench of claim 30 where said first slot extends along a first slot longitudinal axis at an angle to said first jaw axis, said second slot extends along a longitudinal axis at an angle to said second jaw axis, said first slot longitudinal axis and said second slot longitudinal axis pointing toward said handle.

32. The wrench of claim 29 where said adjusting means further comprises a first cam and a second cam, on said handle, a first cam receiving surface on said first jaw between said handle and said first pivot operatively engaged by said first cam for pivoting said first jaw toward said second jaw, a second cam receiving surface on said second jaw between said second pivot and said handle operatively engaged by said second cam for pivoting said second jaw toward said first jaw.

33. The wrench of claim 32 where said first cam surface is on a surface of said first jaw facing away from said second jaw and said second cam surface is on a surface of said second jaw facing toward said first jaw.

34. The wrench of claim 33 where the length of each of said jaws nearest said handle angles inwardly towards said handle, said cam receiving surfaces being along said length nearest said handle.

35. The wrench of claim 27 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

36. The wrench of claim 28 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

37. The wrench of claim 30 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

38. The wrench of claim 32 where said plate means comprises a first plate pivotally secured to said first jaw through said first pivot and a second plate pivotally secured to said second jaw through said second pivot, said second plate also being pivotally secured to said handle through said plate pivot, said first plate and said second plate being arranged to slide over one another at an angle to the axes of said jaws, guide means for guiding said plates at said angle when sliding over one another.

39. The wrench of claim 35 where said guide means comprise tongue and groove means in said first and second plate for guiding said plates at said angle.

40. The wrench of claim 35 where said first plate extends around said first jaw and said second plate extends around said second jaw.

41. The wrench of claim 27 further comprising resilient means affixed to said wrench for returning said jaws to a set position after said jaws are opened.

42. The wrench of claim 27 where said first pivot and said second pivot lie along an axis that intersects said longitudinal jaw axes at a 45° angle.

43. The wrench of claim 27 where said first pivot and said second pivot lie along an axis that intersects said longitudinal jaw axes at a 60° angle.

44. The wrench of claim 27 where said first pivot and said second pivot lie along an axis that intersects said longitudinal jaw axes at an 80° angle.

45. The wrench of claim 27 where the ratio of the distance from:

(1) said first pivot to said jaw engaging means next adjacent first pivot and (2) said jaw engaging means to said plate pivot comprises a first ratio which is at substantially fixed value and the ratio of the distance from:

(1) said second pivot to said jaw engaging means next adjacent said second pivot and (2) said jaw engaging means to said plate pivot comprising a second ratio substantially the same as said first ratio.

46. The wrench of claim 45 where said first and second ratios are greater than one.

47. The wrench of claim 46 where said first and second ratios are sufficiently high to enable said jaws to firmly grip a rounded work piece.

48. The wrench of claim 45 where said ratios are at a fixed value in the range from about 1.5:1 to about 5:1.

49. The wrench of claim 27 where the axes of said jaws are in substantially parallel alignment when said jaws are moved toward one another and away from one another.

50. The wrench of claim 27 wherein at least one of said first jaw and said second jaw have a recess therein in the gripping surface thereof for gripping the edge of a nut.

51. The wrench of claim 27 wherein at least one of said first jaw and second jaw have teeth therein in the gripping surface thereof for gripping a round workpiece.

* * * * *